US007550913B2

(12) United States Patent
Guo et al.

(10) Patent No.: US 7,550,913 B2
(45) Date of Patent: Jun. 23, 2009

(54) FIELD EMISSION DEVICE HAVING GETTER MATERIAL

(75) Inventors: Cai-Lin Guo, Beijing (CN); Li Qian, Beijing (CN); Jie Tang, Beijing (CN); Liang Liu, Beijing (CN); Bing-Chu Du, Beijing (CN); Zhao-Fu Hu, Beijing (CN); Pi-Jin Chen, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 306 days.

(21) Appl. No.: 11/453,453

(22) Filed: Jun. 14, 2006

(65) Prior Publication Data

US 2007/0069631 A1 Mar. 29, 2007

(30) Foreign Application Priority Data

Sep. 29, 2005 (CN) ..... 200510100047.6

(51) Int. Cl.
*H01J 1/62* (2006.01)

(52) U.S. Cl. ..... 313/495; 313/309

(58) Field of Classification Search ..... 313/495, 313/309, 336, 351
See application file for complete search history.

(56) References Cited

U.S. PATENT DOCUMENTS

| | | | | |
|---|---|---|---|---|
| 5,223,766 | A * | 6/1993 | Nakayama et al. | 313/495 |
| 5,469,014 | A * | 11/1995 | Itoh et al. | 313/308 |
| 5,545,946 | A | 8/1996 | Wiemann | |
| 6,033,278 | A | 3/2000 | Watkins et al. | |
| 6,236,156 | B1 * | 5/2001 | Ito | 313/495 |
| 6,876,141 | B2 | 4/2005 | Pavani Filho et al. | |
| 2001/0004979 | A1 | 6/2001 | Han et al. | |
| 2001/0006842 | A1 | 7/2001 | Hattori | |
| 2005/0189868 | A1 | 9/2005 | Ahn et al. | |

* cited by examiner

*Primary Examiner*—Vip Patel
(74) *Attorney, Agent, or Firm*—D. Austin Bonderer

(57) ABSTRACT

A field emission device (100) generally includes a front substrate (101) and a rear substrate (111) opposite thereto. The front substrate is formed with an anode (102). The rear substrate is formed with cathodes (112) facing the anode. A plurality of insulating portions (121) are formed on the rear substrate, each of which is arranged between every two neighboring cathodes. A plurality of gate electrodes are formed on top surfaces of the insulating portions 121. Each of the gate electrodes has a getter layer (123) thereon.

17 Claims, 2 Drawing Sheets

FIELD EMISSION DEVICE HAVING GETTER MATERIAL

TECHNICAL FIELD

The present invention relates to a field emission device, and particularly to a field emission device having getter material.

BACKGROUND

Field emission devices are packaged vacuum microelectronic devices that are used in connection with computers, television sets, camcorder viewfinders, and other electronic devices. Field emission devices generally have a rear plate and a front plate facing each other with a narrow vacuum gap therebetween. In large field emission devices, a number of spacers are positioned between the rear plate and the front plate to prevent atmospheric pressure from collapsing the plates together. The rear plate typically has a base substrate upon which a number of sharp, cone-shaped emitters are formed, an insulator layer positioned on the substrate having apertures through which the emitters extend, and an extraction grid formed on the insulator layer around the apertures.

One problem with field emission devices is that the internal components continuously outgas, which causes the performance of field emission devices to degrade over time. The effects of outgassing are minimized by placing a special material to absorb the gas (commonly called getter material) within the sealed vacuum chamber. Accordingly, in order to absorb the gas in the vacuum chamber over a field emission device's lifetime, a sufficient amount of getter material must be incorporated into the field emission device before it is sealed.

In operation, getter materials are usually arranged in a corner of the field emission device, but the conductance from the outgassing site to these getters are limited by the narrow space between the flat plates, causing reduction of the getters' absorption efficiency and in consequence the display's performance and lifetime. There are also according solutions in which a separate space for containing getter materials is added to the device, but the structure thereof becomes complicated and the manufacture cost will be increased.

What is needed, therefore is to provide a field emission device having getter material that has a high absorption efficiency.

SUMMARY

A field emission device provided herein generally includes: a cathode having a plurality of emitters thereon; an anode arranged over the cathode; and a functional electrode interposed between the cathode and anode. The functional electrode is used to control electron emission of the emitters, and includes getter material.

These and other features, aspects, and advantages of the present field emission device will become more apparent from the following detailed description and claims, and the accompanying drawings.

BRIEF DESCRIPTION OF THE DRAWINGS

Many aspects of the present field emission device can be better understood with reference to the following drawings. The components in the drawings are not necessarily drawn to scale, the emphasis instead being placed upon clearly illustrating the principles of the present field emission device.

Moreover, in the drawings, like reference numerals designate corresponding parts throughout the several views.

DETAILED DESCRIPTION OF THE PREFERRED EMBODIMENTS

Figure 1:
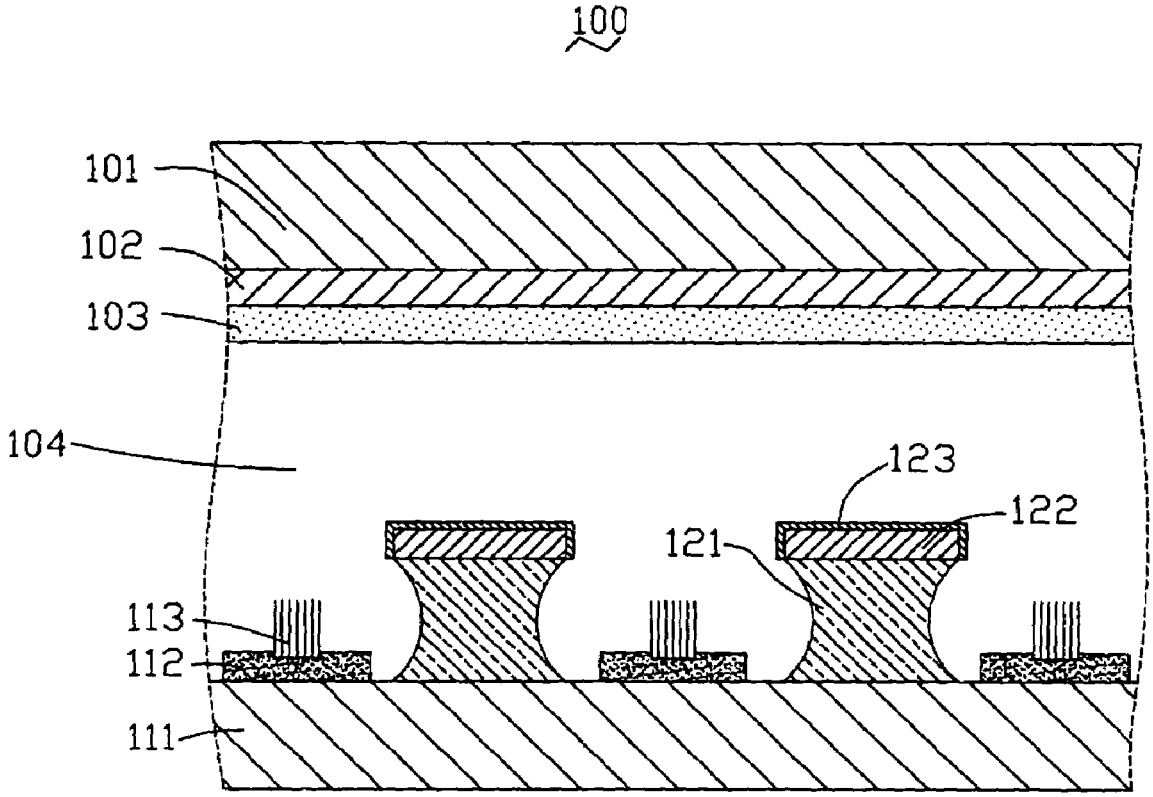
FIG. 1 is a schematic, cross-sectional view of a field emission device in accordance with a first embodiment.

Referring to FIG. 1, a field emission device 100 is shown in accordance with a first embodiment. The field emission device 100 generally includes a front substrate 101 and a rear substrate 111 opposite to each other. The front substrate 101 is formed with an anode 102. The rear substrate 111 is formed with striped cathodes 112 facing the anode 102. Several sidewalls and spacers (not shown) are interposed between the front substrate 101 and the rear substrate 111. A substantial vacuum is maintained in a chamber 104 between the front substrate 101 and the rear substrate 111.

In the illustrated embodiment, the front substrate 101 is made of glass, plastics, or other suitable materials. The anode 102 is a conductive layer formed on the front substrate 101, and is generally made of indium-tin oxide. Fluorescent layers 103 are formed on a cathode-facing surface of the anode 102.

The rear substrate 111 is made of glass, plastics, or other suitable materials. The cathodes 112 are electrically conductive layers, and formed on a surface of the rear substrate 111 facing the anode 102. A plurality of emitters 113 are formed on the cathodes 112, for emitting electrons. The emitters 113 can be composed of carbon nanotubes, diamond, diamond-like carbon (DLC), silicon, or of a tip-shaped metal material.

A plurality of insulating portions 121 are formed on the rear substrate 111, each of which is arranged between two neighboring cathodes 112.

A plurality of gate electrodes 122 are formed on top surfaces of the insulating portions 121, for extracting electrons from the emitters 113. An outer surface of each of the gate electrodes 122 faces the chamber 104 except the portion contacts the insulating portion 121. Each of the gate electrodes 122 has a getter layer 123 covering the chamber-facing outer surface. The getter layers 123 cover surfaces of the gate electrodes 122. Thereby, the getter layers 123 have distributed broadly, and have larger absorption area. Further, the getter layers 123 are arranged near to the fluorescent layers 103 where the outgassing usually occurs during the electron impinging process. As a result, an absorption efficiency will be obviously increased, and gas pressure of everywhere of the chamber 104 of the field emission device 100 will become more uniform. Accordingly, the field emission device 100 will have a longer life.

The gate electrodes 122 are made of silver or other suitable metal. A material of the getter layers 123 is non-evaporable getter material, such as tantalum (Ta), zirconium (Zr), titanium (Ti), hafnium (Hf), and/or their alloys. The getter layers 123 preferably have a thickness in a range from about 5 microns to about 30 microns. The getter layers 123 could be formed on the gate electrodes 122 by printing or other suitable process.

Figure 2:
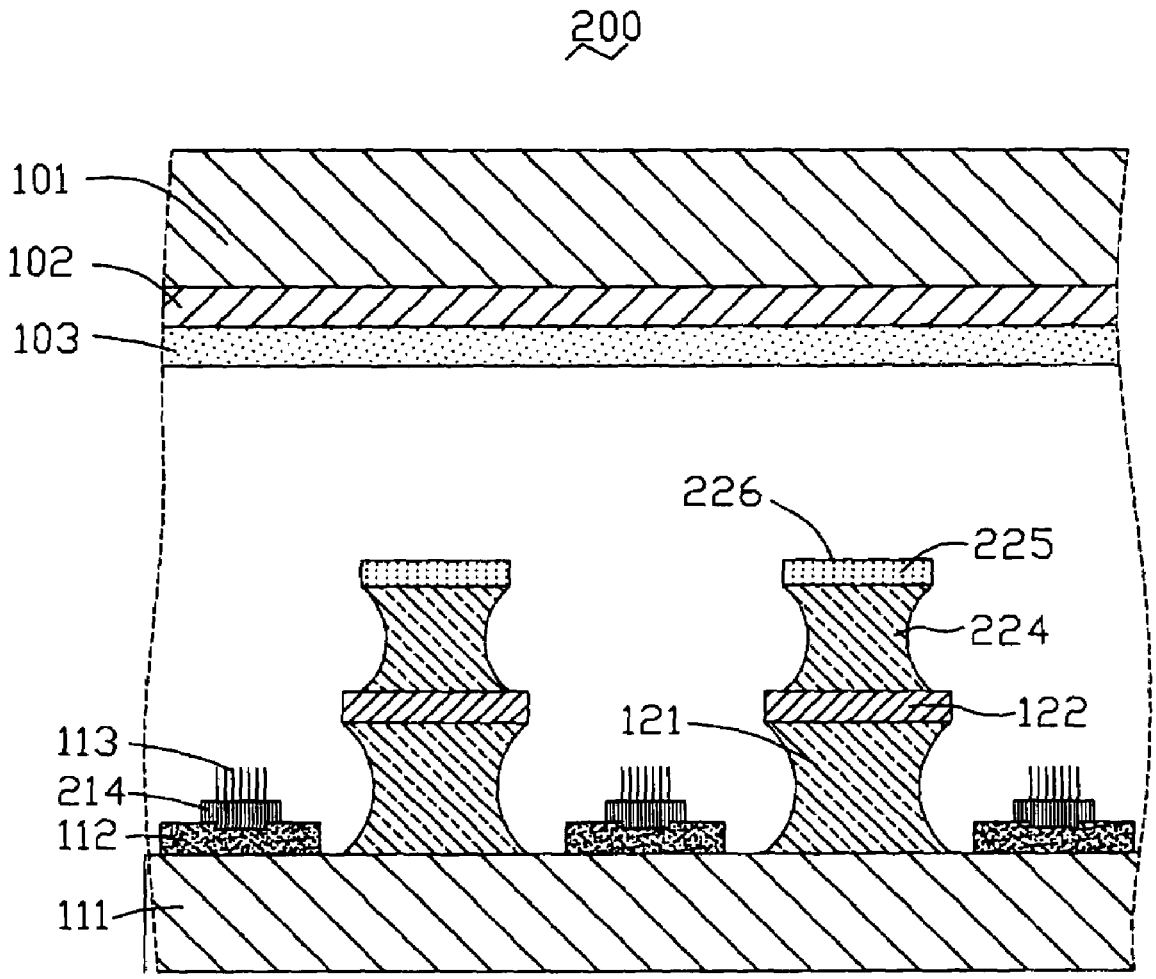
FIG. 2 is a schematic, cross-sectional view of a field emission device in accordance with a second embodiment.

Referring to FIG. 2, another field emission device 200 is shown in accordance with a second embodiment. The main difference between the field emission devices 100 and 200 is that the field emission device 200 is four-electrode type. That is, the field emission device 200 further has focusing electrodes 225 over the gate electrodes 122. Insulating portions 224 are interposed between the gate electrodes 122 and the focusing electrodes 225.

Further, in the embodiment, the focusing electrodes 225 include getter material 226 distributing therein. In process, the getter material 226 may be added into the material of the focusing electrodes 225 before the formation of the focusing electrodes 225.

Moreover, the field emission device 200 includes the emitters 113 having getter material 214 distributing therein. In process, the getter material 214 may be added into the material of the emitters 113. Thereby, the getter material 214 can distribute uniformly in the emitters 113. Accordingly, a higher absorption efficiency will be obtained.

Otherwise, the gate electrodes 122 may further include the getter material 226 distributed therein, for providing larger absorption area.

It should be further noted that the above-described field emission device 100, 200 have been provided for the purposes of illustrating the present invention. The field emission device 100, 200 are not critical to practicing the present invention. A variety of conventional field emission devices are known to those skilled in the art, and these may be suitably adapted for practicing the present invention.

Finally, while the present invention has been described with reference to particular embodiments, the description is illustrative of the invention and is not to be construed as limiting the invention. Therefore, various modifications can be made to the embodiments by those skilled in the art without departing from the true spirit and scope of the invention as defined by the appended claims.

What is claimed is:

1. A field emission device comprising:

a cathode having a plurality of emitters thereon;

an anode arranged over the cathode;

a fluorescent layer formed on a cathode-facing surface of the anode; and a functional electrode interposed between the cathode and anode so as to control electron emission of the emitters, wherein an outer surface of the functional electrode is enveloped by a getter layer comprised of getter material, and the getter layer is arranged adjacent to the fluorescent layer.

2. The field emission device according to claim 1 wherein the functional electrode is a gate electrode.

3. The field emission device according to claim 1, wherein the functional electrode is a focusing electrode.

4. The field emission device according to claim 3, wherein the field emission device further comprises a gate electrode between the cathode and the focusing electrode.

5. The field emission device according to claim 1, wherein the getter material is non-evaporable getter material.

6. The field emission device according to claim 1, wherein the getter material is distributed within the functional electrode.

7. The field emission device according to claim 1, wherein the functional electrode is made of silver.

8. The field emission device according to claim 1, wherein a material of the emitters is selected from the group consisting of carbon nanotubes, diamond, diamond-like carbon (DLC), and silicon.

9. The field emission device according to claim 1, wherein a thickness of the getter layer is in a range from about 5 microns to about 30 microns.

10. The field emission device according to claim 1, wherein the getter layer is formed on the functional electrode by printing.

11. The field emission device according to claim 1, wherein the getter material further distributes in the emitters.

12. A field emission device comprising:

a pair of parallel substrates facing each other with a sealed chamber formed therebetween;

a cathode arranged on one of the substrates within the sealed chamber;

an anode arranged on the other of the substrates within the sealed chamber, a fluorescent layer being arranged over the anode and facing the cathode;

a plurality of emitters extending from the cathode toward the anode and configured for emitting electrons to impinge the fluorescent layer;

a gate electrode disposed between the cathode and the anode and facing the fluorescent layer, wherein a getter layer made of getter material is located on and encloses exposed surfaces of the rate electrodes, and the setter layer is arranged adjacent to the fluorescent layer for absorbing outgassed material from the fluorescent layer.

13. The field emission device of claim 12, wherein the getter material is distributed within the gate electrode.

14. The field emission device of claim 12, further comprising an insulating portion on which the gate electrode is arranged.

15. The field emission device of claim 12, wherein the getter layer has a thickness in a range from 5 to 30 microns.

16. The field emission device of claim 12, further comprising an additional gate electrode disposed between the gate electrode and the cathode, wherein the gate electrode acts as a focusing electrode.

17. The field emission device of claim 12, wherein the emitters contain the getter material which is distributed within the emitters.

* * * * *